US008474201B2

(12) United States Patent
Smith

(10) Patent No.: US 8,474,201 B2
(45) Date of Patent: Jul. 2, 2013

(54) ONE-PIECE INTEGRATED COMPOSITE WALL FOUNDATION AND FLOOR SLAB SYSTEM

(76) Inventor: Rodney I. Smith, Midland, VA (US)

( * ) Notice: Subject to any disclaimer, the term of this patent is extended or adjusted under 35 U.S.C. 154(b) by 162 days.

(21) Appl. No.: 12/959,806

(22) Filed: Dec. 3, 2010

(65) Prior Publication Data

US 2011/0131906 A1 Jun. 9, 2011

Related U.S. Application Data

(60) Provisional application No. 61/266,369, filed on Dec. 3, 2009.

(51) Int. Cl.
*E04C 5/08* (2006.01)

(52) U.S. Cl.
USPC ..... 52/223.7; 52/223.6; 52/284

(58) Field of Classification Search
USPC ..... 52/223.6, 223.7, 274, 284, 294, 591.4, 52/79.14
See application file for complete search history.

(56) References Cited

U.S. PATENT DOCUMENTS

| | | | | |
|---|---|---|---|---|
| 2,971,295 | A * | 2/1961 | Reynolds | 52/223.7 |
| 3,173,226 | A * | 3/1965 | Solnick | 52/89 |
| 4,627,203 | A * | 12/1986 | Presswalla et al. | 52/220.5 |
| 2003/0233798 | A1 * | 12/2003 | Berkey et al. | 52/223.7 |
| 2010/0154332 | A1 * | 6/2010 | Shockley et al. | 52/223.3 |

* cited by examiner

*Primary Examiner* — Jeanette E Chapman
*Assistant Examiner* — Daniel Kenny
(74) *Attorney, Agent, or Firm* — Whitham Curtis Christofferson & Cook, PC

(57) ABSTRACT

A unitary, composite wall foundation and floor slab structure and system is provided by a pre-stressed cast concrete structure having a wall foundation region, a floor slab region and a transitional region therebetween and strands passing through all of those regions. One or more such structures are also post-tensioned using cables passing through tube embedded in the cast concrete structure and, when a plurality of such structures are employed in a modular manner, such post-tensioning draws all such modules into a larger unitary composite wall foundation and floor slab structure. The transition region may be further reinforced by angular reinforcing elements. Intermediate and end sections of varied shape may be used to complete the structure.

9 Claims, 5 Drawing Sheets

ONE-PIECE INTEGRATED COMPOSITE WALL FOUNDATION AND FLOOR SLAB SYSTEM

CROSS-REFERENCE TO RELATED APPLICATIONS

This application claims priority of the filing date of U. S. Provisional Patent Application 61/266,369, filed Dec. 3, 2009, which is hereby incorporated by reference in its entirety.

FIELD OF THE INVENTION

The present invention generally relates to prefabricated wall foundation and floor slab components for buildings and, more particularly, to an integrated composite, one-piece, combination floor slab and wall foundation structural component utilizing pre-stressing and post-tensioning, and optionally but preferably, an engineered compacted stone sub-base extending at least below a frost or freeze line or depth to produce a combined or composite wall foundation and floor slab for buildings of substantially any size.

BACKGROUND OF THE INVENTION

Many structures have been built of many different types of materials and of widely varying sizes and designs for many different purposes and many others are foreseeable. All such structures will have the common design factor of the weight of the materials of which they are built and, if intended to be utilized for more than a very short period of time, must be provided with a foundation which will stably and substantially immovably support the weight of the structure on the material (e.g. soil) underlayment naturally present at the desired location of the structure.

In general, a barrier is also desirable over the natural underlayment which can function as a floor capable of carrying substantial loads. Such a barrier is often provided by a concrete slab which is poured in place within the foundation inner perimeter. The slab may be reinforced to increase the strength thereof and to prevent damage from temperature changes and hydrostatic forces and the like which may occur.

However, if such a slab or other structure is formed within the perimeter of a foundation structure, it will usually be at least imperfectly integral therewith even if some structural connection is provided; allowing differential settling of the slab or other structure relative to the foundation and/or moisture seepage between the foundation and slab or other structure. Further, for some soil types, it may be desirable to have the slab or other structure function as part of the foundation such that the building will essentially "float" on an area of soil which is much increased from the area upon which the foundation, itself, rests. This latter concern requires a substantial degree of structural integration of the foundation and slab or other structure that may not be achieved with high confidence when the foundation and slab are separately formed in situ, as is the current practice. The desired size of a structure may require conventional techniques to be performed in a manner which may compromise the joint functions of the wall foundation and the floor slab to support the building and provide a load bearing barrier.

Additionally, since most such structures are built in response to a recognized or anticipated need, the time required for providing a suitable foundation and slab is an important factor in the building of any structure and may not be adequately satisfied with in-situ construction techniques, particularly in view of the time and labor required for concrete finishing (e.g. to obtain the desired surface finish or texture) and the time required for curing of the concrete to attain sufficient strength for further construction to be performed (usually on the order of several days although concrete will continue to cure and increase in strength over a period of weeks or months). Moreover, at the present time, buildings which are intended to be temporary and/or capable of being relocated or rebuilt while utilizing a minimum of new material and a maximum of previously used structural components (or are of a construction which at least provides that potential) are of particular interest and usually of increased value for that reason.

SUMMARY OF THE INVENTION

It is therefore an object of the present invention to provide a combination or composite wall foundation and floor slab structure or module which can be assembled with other modules and which can be pre-stressed and post-tensioned into a unitary, integral structure for a building of substantially any size and which can be disassembled, transported and reassembled with a minimum of cost and effort.

It is a further object of the invention to provide a composite floor slab and wall foundation structure of increased strength and integrity at a transition between the structure functioning principally as a wall foundation and the structure functioning principally as a floor slab.

In order to accomplish these and other objects of the invention, a composite, unitary wall foundation and floor slab structure and system is provided having a wall foundation region, a floor slab region and a transitional region therebetween including a unitary body of cast concrete forming the wall foundation region, the floor slab region and the transitional region, an array of strands passing through the wall foundation region, the floor slab region and the transitional region for pre-stressing the structure over its length, and tubes for accommodating post tensioning cables oriented across a width of the structure. The structure/system thus constituted may be supported by a volume of compacted stone extending to a freeze line of the site.

In accordance with another aspect of the invention, a method of forming a wall foundation and floor slab for a building is provided comprising steps of forming a region of compacted stone in an excavated volume, positioning one or more unitary, composite wall foundation and floor slab structures of pre-stressed concrete on said region of compacted stone, and post-tensioning said one or more unitary, composite wall foundation and floor slab structures.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
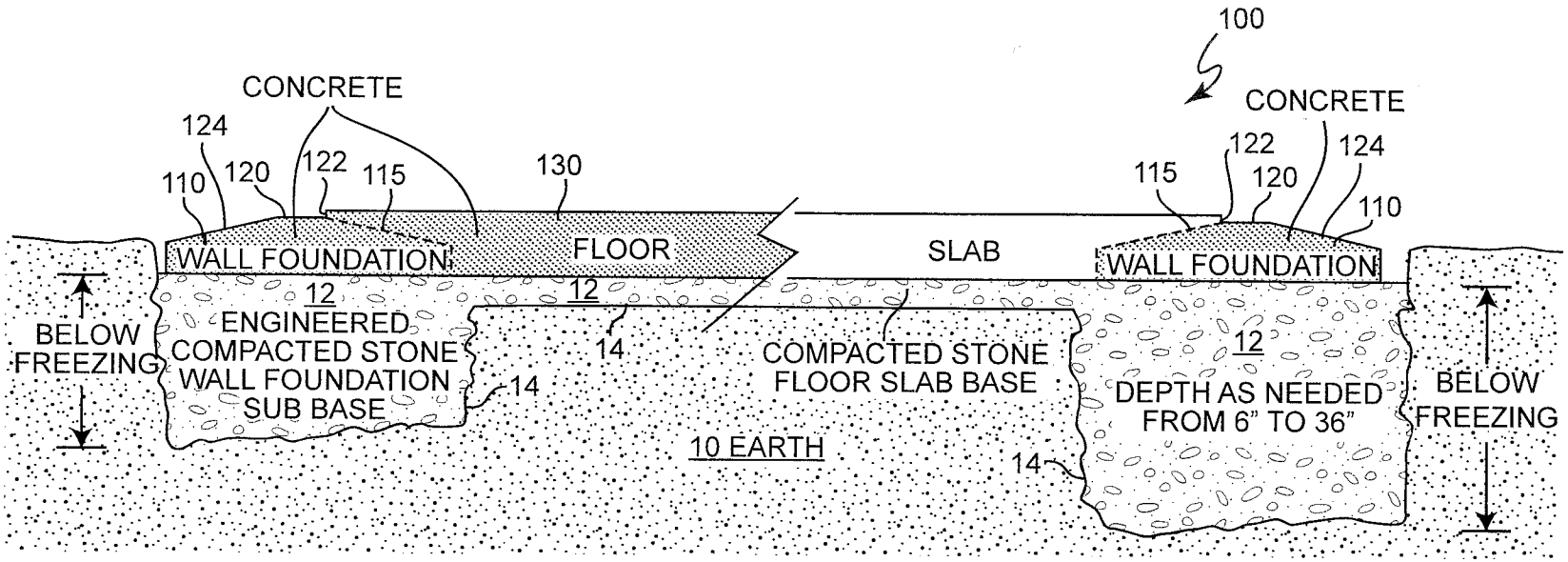
FIG. 1 is a cross-sectional view of the composite wall foundation and floor slab in accordance with the invention as preferably installed at a building site.

Referring now to the drawings, and more particularly to FIG. 1, there is shown a generalized cross-sectional view of the composite wall foundation and floor slab in accordance with the invention (but with internal details of the wall foundation and floor slab structure omitted for clarity) as preferably installed at a building site. Preferred internal details of the composite wall foundation and floor slab are illustrated in detail in FIGS. 2-4B and will be discussed in detail below. It should be understood that the depiction of the invention is neither to scale or illustrative of desired proportions; the geometry of some features of the invention being exaggerated for clarity.

Figure 3A:
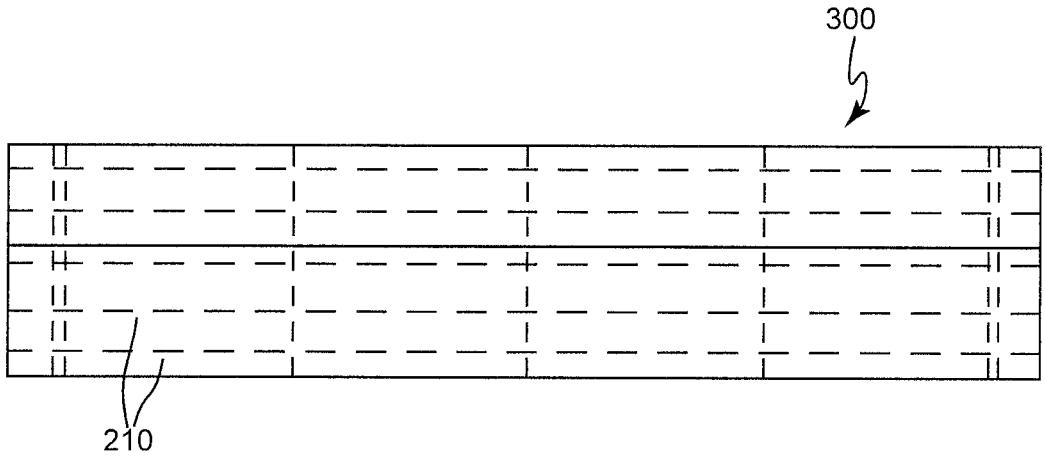
Figure 4A:
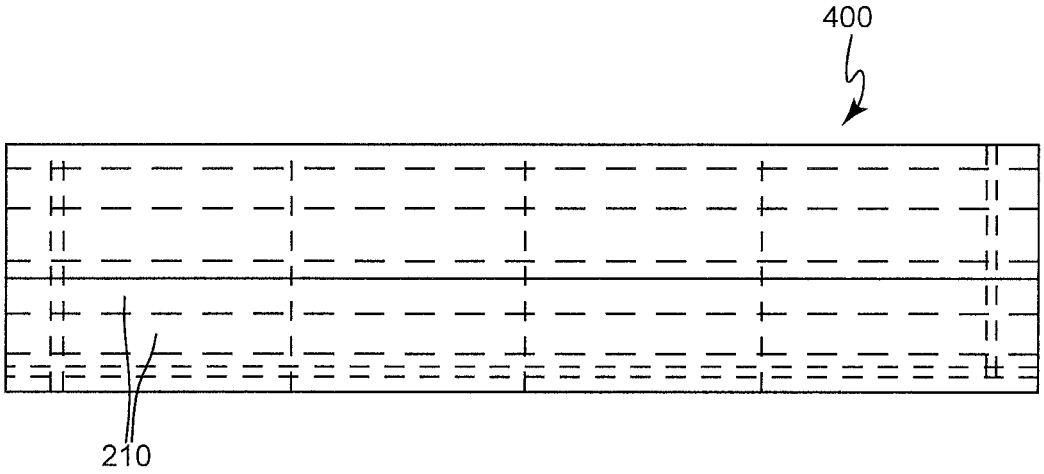
FIGS. 4A and 4B are plan and cross-sectional views of an end panel in accordance with a perfecting feature of the invention.

The overall shape of the composite wall foundation and floor slab or a module thereof 100 (sometimes collectively referred to hereinafter, for brevity, as a foundation/slab or foundation/slab module) is a rectangular sheet of a thickness as may be required by anticipated load conditions. The edges thereof are preferably tapered slightly in a region 124 outside a wall location to provide for water run-off. However, such tapering is not important to the practice of the invention and would preferably be omitted if the dimensions of the building and/or requirements for internal supports or load-bearing walls were such that more than one foundation/slabs are required to be installed end-to-end (e.g. instead of or in addition to being installed side-to-side); in which case an interlocking joint at the edges(s) of the foundation/slabs, as illustrated in FIGS. 3A and 4A and discussed below would preferably be provided.

In general, the overall dimension of the slab (from left to right, as illustrated) should be about 12 to 24 inches larger than the external dimensions of the building "footprint" on the site but are preferably limited to about forty-four feet (from left to right, as illustrated) and about ten feet (perpendicular to the plane of the page) for convenience of handling and transportation and accommodation of stresses imposed from the environment (e.g. expansion or contraction with temperature and other environmental conditions such as hydrostatic pressure) and anticipated loads imposed on the floor slab. Lengths may also be in multiples of ten feet up to sixty feet consistent with convenience of transportation and handling.

As illustrated in FIG. 1, it is preferred that the foundation/slab in accordance with the invention be installed on an engineered compacted stone sub-base 12 to accommodate freezing conditions. Engineered compacted stone 12 is installed in an excavated volume 14 within soil 10 which is of dimensions as may be required by the type of soil, weight of the building and other well-known and well-understood factors in the building industry. The depth should extend below the so-called freeze line (e.g. the depth to which the soil is likely to freeze at the site). Depending on the soil type, moisture content, climate and the like, a depth of six to thirty-six inches is usually sufficient as a foundation for most building applications. The depth within the inner perimeter of the foundation is not critical to the practice of the invention other than to provide even support for the floor slab portion of the foundation/slab such that no significantly concentrated forces will occur due to uneven loading of the floor slab by building contents.

Once the dimensions of the excavation 14 are determined through standard engineering practices, the volume of the excavation is filled with stone (e.g. granite) which has been crushed to produce a relatively wide range of small sizes from the size of small pebbles down to a granularity comparable to sand. Multiple layers which are individually relatively thin (e.g. a few inches or less) are formed by depositing crushed stone and compacting it with a powered compactor apparatus that, in general, applies repeated impact forces on the crushed stone. The resulting vibration settled the variety of sizes of crushed stone into a tightly nested arrangement which is generally very stable under relatively constant load and which exhibits a rigidity under compression comparable to fully cured concrete.

While it is to be clearly understood that the foundation/slab 100 in accordance with the invention is manufactured and provided as a single piece structure or body, distinct (but not separate) wall foundation regions 110 and floor slab regions 130 will exist, as indicated by dashed lines 115, and that these regions will generally have different loads or stresses of different natures and characteristics applied thereto and which these regions must withstand. Specifically, wall foundation region 110 will generally be subjected to large static loads in flat regions 120 which are engendered by a wall or internal supports of the building which are usually distributed over a significant area while the floor slab region 130 will generally be subjected to lesser but variable loading which may be irregular and/or concentrated such as at the tires of a vehicle which the building is to house which may cause shear stresses that must be carried by the thickness of the floor slab. Preferred internal structures of the respective regions 110, 130 to accommodate these respective types of loads and a transitional structure bridging foundation region 110 and floor slab region 130 and which results in a step 122 which is particularly useful for locating and attaching a wall or internal support structure in flat region 120 of the foundation region and provides increased structural integrity in the transition region between the wall foundation region and the floor slab region of the foundation/slab structure will be discussed in detail below in connection with FIGS. 2-4B.

Figure 2:
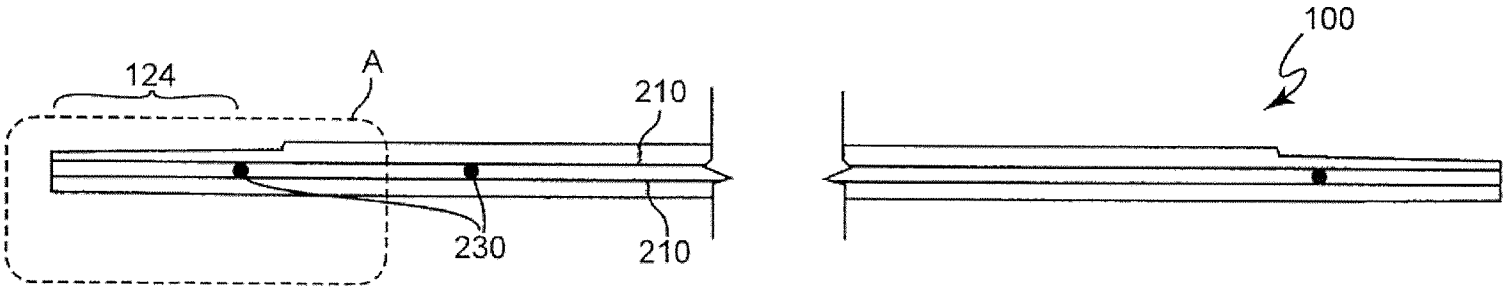
FIG. 2 is a cross-sectional view of the composite wall foundation and floor slab in accordance with the invention showing preferred internal details therefor.
Figure 2A:
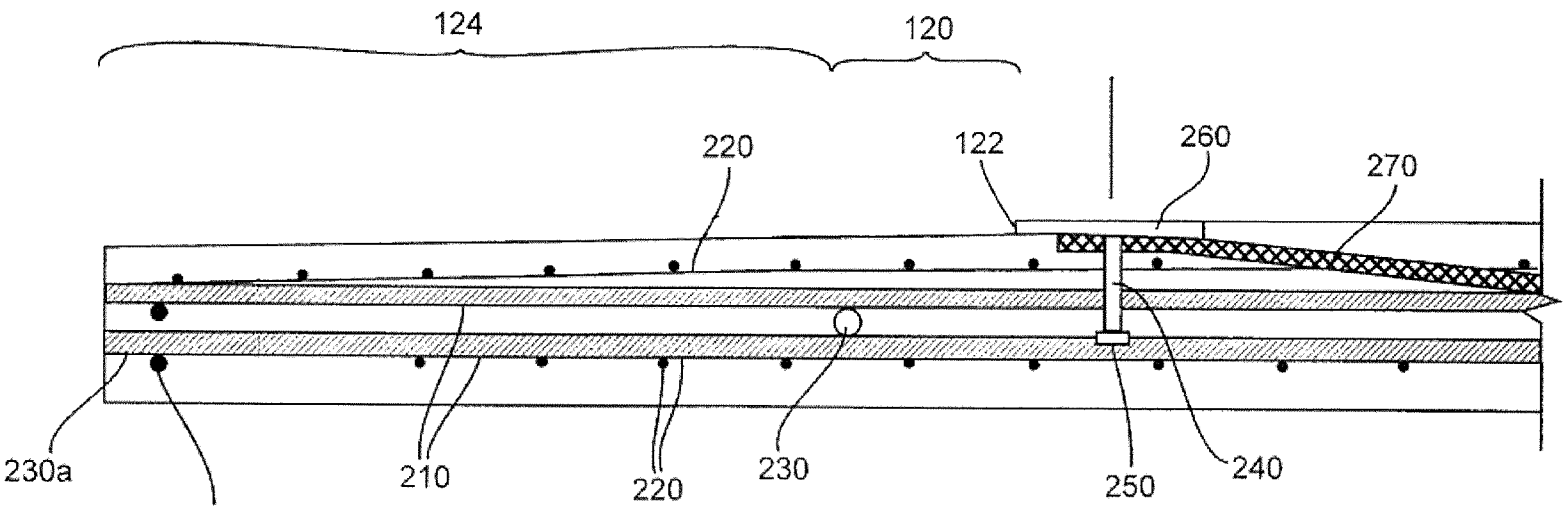
FIG. 2A is a cross-sectional view of detail A of FIG. 2, FIGS. 3A and 3B are plan and cross-sectional views of an intermediate panel in accordance with a perfecting feature of the invention.

Referring now to FIGS. 2 and 2A, preferred internal structure of the foundation/slab 100 will now be discussed. It should be understood that the orientation of the foundation/slab 100 shown in FIGS. 2 and 2A correspond to the orientation of the foundation/slab or foundation/slab module as it is to be installed shown in FIG. 1 but that the foundation/slab or module 100 would generally and preferably be formed by casting in a mold or other known technique in which the formation of taper 124 may be facilitated by forming foundation/slab 100 in an orientation which is inverted from that shown. Such inverted orientation during manufacture also can eliminate or limit concrete finishing processes by developing a desired surface texture in a mold or the like apparatus for manufacturing the foundation/slab body.

The foundation/slab or foundation/slab module 100 is preferably formed of cast concrete which is poured around the internal structure illustrated, particularly in the detail of FIG. 2A indicated by a dashed line and reference character A in FIG. 2. The principal elements of the internal structure of the foundation/slab 100 include multiple prestressed cables or rods, collectively referred to as strands, 210 which extend through the entirety of the foundation/slab 100 or module therefor and may be terminated by any structure (e.g. rod 205) known to be suitable for the purpose or simply embedded without termination. These cables or rods would typically be placed in tension prior to the concrete pour and, after a suitable amount of curing of the concrete, would be released to thus provide a compressive force on the concrete of the structure.

It is also preferred to provide wire mesh structures 220, shown in the detailed view of FIG. 2A but omitted from FIG. 2 for clarity, above and below the array of prestressed cables or rods 210 and which are preferably arranged at a fixed distance from the surface of the foundation/slab 100 in order to provide additional strength to and stabilize the surface of the foundation/slab 100. Thus toward the edge of the foundation slab 100, in tapered region 124 (and any other location where it may be desirable to shape the surface of the foundation/slab) the wire mesh 220 preferably follows the contour of the surface, as shown.

Particularly if more than a single foundation slab 100 is to be used for a given building structure, tubes 230 are preferably provided generally perpendicular to the plane of the cross-section of FIG. 2A across the width of the foundation/slab body and between the prestressed cables and/or rods 210. If plural foundation/slab modules are to be placed end-to-end, as alluded to above, similar tubes can be provided parallel to the plane of the page and essentially in parallel with or substituting for one or more of pre-stressed cables or rods 210; the illustration of which should be understood as being inclusive thereof as indicated by reference numeral 230*a*. When the foundation/slab modules are assembled on the building site, cables can then be passed through the tubes and used to pull the modules together into a unitary overall structure and then left in place under tension to provide so-called post-tensioning in the assembled unitary structure. For example, ten foundation/slab modules of forty-four foot length and 10 foot width may be assembled together side-to-side and held in compression by post-tensioning in this manner to yield a forty-four foot by one hundred foot slab with integral wall foundation. Another ten modules could be attached to either end to yield an eighty-eight foot by one hundred foot slab with integral foundation including a foundation region of suitable structure to carry the load of internal building supports or load-bearing walls. Even if only a single foundation/slab structure is used for a building, it is preferred to provide post-tensioning across its width and length to further increase the strength of the foundation/slab in accordance with the invention.

As alluded to above, in reference to the wall foundation region 110 and floor slab region 130 which were generally delineated by dashed line 115 in FIG. 1, the transition region, which may be considered as generally surrounding the location of line 115, is preferably strengthened to carry the different stresses in each region and which, in practice, may overlap and be superimposed to a degree that is not readily quantitatively determinable and may result in regions of concrete being placed in tension. This strengthening is preferably achieved by providing pins 240 having anchoring heads 250 or the like and preferably attached to the lower course of pre-stressed rods or cables 210 and to which pins 240 may be attached and which extend to plate(s) 260 which also facilitate attachment of wall segments by, for example, welding. Plate 260 may be, for example, continuous or separated plates of one-half inch thick steel plate and which also forms a perimeter for the floor slab region; a surface of which is preferably coplanar with the surface of the plate and is thus anchored by pin 240 which also serves to reinforce the transition region. Further reinforcement of the transition region may be achieved by attaching a length of reinforcing rod(s) 270 or the like to plate 260 with an angular disposition to preferably follow the approximate location of line 115 near the inner periphery of the wall foundation region 110. Thus, the transition region between the foundation region 110 and the floor slab region 130 may be provided with an additional degree of confinement in both the horizontal and vertical directions to increase the strength of the foundation/slab throughout the transition region to assure that no region of the concrete is placed in tension.

Figure 3B:
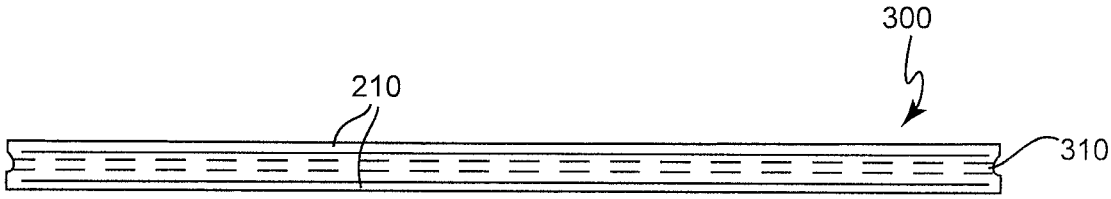
Figure 4B:
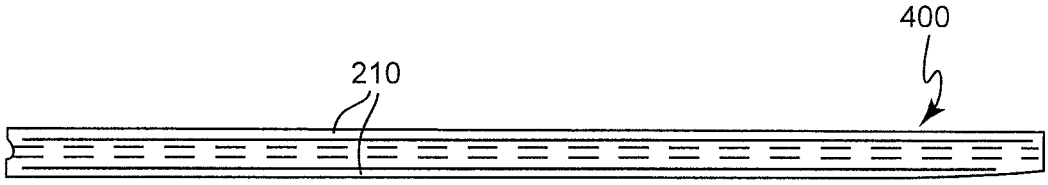
Figure 5:
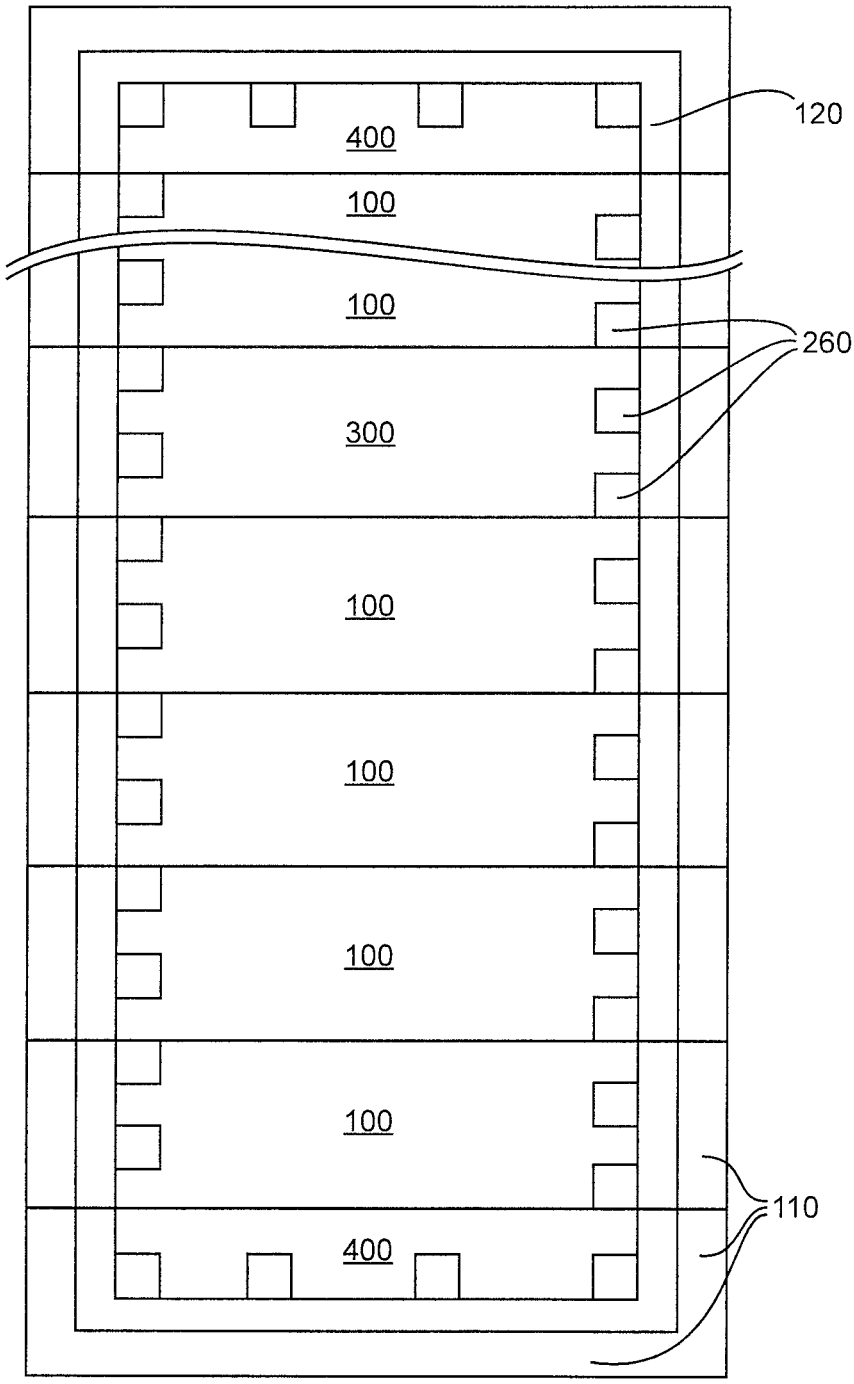
FIG. 5 illustrates an exemplary arrangement of a plurality of wall foundation and floor slab modules together with end and intermediate panels.

As perfecting features of the invention, additional end panels, illustrated in FIGS. 3A and 3B, and intermediate panels, illustrated in FIGS. 4A and 4B may be provided having a length corresponding to the width of the foundation/slab modules. (FIGS. 3B and 4B show these panels in an inverted orientation as may be preferable for their manufacture.) For example, if the width of foundation/slab modules is ten feet, the length of intermediate panels would be ten feet and the length of end panels would be ten feet, six and one-half inches to provide a tapered region corresponding to the foundation/slab modules at one end thereof. The other end (or both ends of an intermediate panel) and the edges of both intermediate and end panels are preferably provided with sectional shapes 310 which interlock with adjoining modules or provide for grout joints to be formed therebetween as may be desired or required by a given design. Some end panels may be tapered along one edge, as well, to match the tapers 124 of the modules 100. Both the intermediate and end panels have internal structures and features similar to those of the modules 100 described above with reference to FIG. 2 but, like those modules 100, may be varied as desired to form a coherent unitary structure to support and form a floor barrier for a building. An exemplary arrangement of a plurality of foundation/slab modules 100, intermediate panels 300 and end panels 400 is illustrated in FIG. 5.

In view of the foregoing, it is seen that the composite wall foundation and floor slab structure in accordance with the invention provides a structure which may be assembled with like structures and/or intermediate and/or end panels to provide a unitary pre-stressed and post-tensioned concrete structure to support the weight of and form a floor barrier for buildings of any size and which can be disassembled, transported and reassembled with reduced effort and cost and which provides increased integrity and strength between regions functioning principally as wall foundation and principally functioning as a floor slab or barrier, particularly where the floor slab provides significant support for a building on some types of soils.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. A composite unitary wall foundation and floor slab structure having a wall foundation region, a floor slab region and a transitional region therebetween including a unitary body of cast concrete forming said wall foundation region, said floor slab region and said transitional region, an array of strands passing through said wall foundation region, said floor slab region and said transitional region for pre-stressing said structure over its length, and tubes for accommodating post tensioning cables oriented across a width of said structure.

2. The unitary structure as recited in claim 1, further including a pin for reinforcing said transitional region of said structure in the direction of a thickness of said structure.

3. The unitary structure as recited in claim 2, further including a plate which is anchored to said structure by said pin.

4. The unitary structure as recited in claim 3, further including an angled reinforcement element attached to said plate and extending into said cast concrete body of said structure.

5. A composite unitary wall foundation and floor slab system including a structure having a wall foundation region, a floor slab region and a transitional region therebetween, a volume of compacted stone, a unitary body of cast concrete supported by said volume of compacted stone and forming said wall foundation region, said floor slab region and said transitional region, an array of strands passing through said wall foundation region, said floor slab region and said transitional region for pre-stressing said structure over its length, tubes for accommodating post tensioning cables oriented across a width of said structure.

6. The system as recited in claim 5, further including a pin for reinforcing said transitional region of said structure in the direction of a thickness of said structure.

7. The system as recited in claim 6, further including a plate which is anchored to said structure by said pin.

8. The system as recited in claim 7, further including an angled reinforcement element attached to said plate and extending into said cast concrete body of said structure.

9. A method of installing a wall foundation and floor slab for a building, said method comprising steps of forming a region of compacted stone in an excavated volume, positioning one or more composite unitary wall foundation and floor slab structures on said region of compacted stone to support said one or more composite unitary wall foundation and floor slab structures by said region of compacted stone, wherein each of said one or more composite unitary wall foundation and floor slab structures has a wall foundation region, a floor slab region and a transitional region therebetween including a unitary body of cast concrete forming said wall foundation region, said floor slab region and said transitional region, an array of strands passing through said wall foundation region, said floor slab region and said transitional region for pre-stressing said structure over its length, and tubes for accommodating post tensioning cables oriented across a width of said structure for said post-tensioning step, passing post tensing cables through said tubes, and post-tensioning said one or more composite unitary wall foundation and floor slab structures.

* * * * *